US008431812B2

(12) United States Patent
Usui et al.

(10) Patent No.: US 8,431,812 B2
(45) Date of Patent: Apr. 30, 2013

(54) TONE DATA SEARCH APPARATUS AND METHOD

(75) Inventors: Jun Usui, Hamamatsu (JP); Taishi Kamiya, Tokyo (JP)

(73) Assignee: Yamaha Corporation, Hamamatsu-shi (JP)

( * ) Notice: Subject to any disclaimer, the term of this patent is extended or adjusted under 35 U.S.C. 154(b) by 159 days.

(21) Appl. No.: 13/021,637

(22) Filed: Feb. 4, 2011

(65) Prior Publication Data

US 2011/0192272 A1 Aug. 11, 2011

(30) Foreign Application Priority Data

Feb. 5, 2010 (JP) ..... 2010-023907

(51) Int. Cl.
*G10H 1/00* (2006.01)

(52) U.S. Cl.
USPC ..... 84/615; 84/645; 84/653; 84/678

(58) Field of Classification Search ..... 84/600–602, 84/615, 645, 653, 678
See application file for complete search history.

(56) References Cited

U.S. PATENT DOCUMENTS 6,528,715 B1 * 3/2003 Gargi ..... 84/615
7,368,652 B2 * 5/2008 Iketani et al. ..... 84/609
7,812,240 B2 * 10/2010 Streich et al. ..... 84/609
7,838,755 B2 * 11/2010 Taub et al. ..... 84/609
2002/0139238 A1 * 10/2002 Mukaino et al. ..... 84/622
2003/0159565 A1 * 8/2003 Kawashima et al. ..... 84/610
2004/0255758 A1 * 12/2004 Klefenz et al. ..... 84/603
2005/0016362 A1 * 1/2005 Nishitani et al. ..... 84/612
2006/0065105 A1 * 3/2006 Iketani et al. ..... 84/609
2007/0068368 A1 * 3/2007 Hiramastu et al. ..... 84/609
2008/0156177 A1 * 7/2008 Iketani et al. ..... 84/609
2009/0095145 A1 * 4/2009 Streich et al. ..... 84/609
2011/0192272 A1 * 8/2011 Usui et al. ..... 84/622
2012/0011989 A1 * 1/2012 Takahashi ..... 84/626
2012/0031256 A1 * 2/2012 Tsuchiya et al. ..... 84/604
2012/0192701 A1 * 8/2012 Watanabe et al. ..... 84/622

* cited by examiner

*Primary Examiner* — David S. Warren
(74) *Attorney, Agent, or Firm* — Morrison & Foerster LLP

(57) ABSTRACT

Storage section stores therein a plurality of tone data sets each representative of a tone waveform but also a plurality of character data sets in association with the tone data sets, each of the character data sets representing content of the tone waveform, represented by the corresponding tone data set, in character quanta. Display control section causes a display section to display an image with some of the stored tone data sets as selection candidates. Selection section is provided for a user to select at least one of the tone data sets displayed as the selection candidates. Identification section searches for and identifies a plurality of character data sets similar to the character data set corresponding to the user-selected tone data set. The display control section causes the display section to further display an image of a plurality of the tone data sets associated with the identified character data sets.

15 Claims, 3 Drawing Sheets

| TONE DATA SET | CHARACTER DATA SET | | | | |
|---|---|---|---|---|---|
| | P1 | P2 | P3 | P4 | ••• |
| TONE DATA SET M1 | 10 | 45 | 30 | 73 | ••• |
| TONE DATA SET M2 | 25 | 33 | 45 | 55 | ••• |
| ⋮ | ••• | ••• | ••• | ••• | ••• |

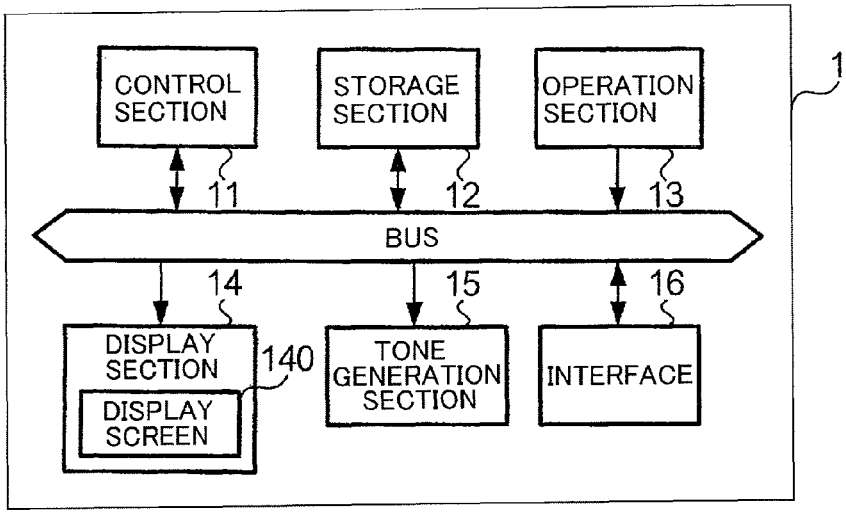
F I G. 1
| TONE DATA SET | CHARACTER DATA SET | | | | |
|---|---|---|---|---|---|
| | P1 | P2 | P3 | P4 | ••• |
| TONE DATA SET M1 | 10 | 45 | 30 | 73 | ••• |
| TONE DATA SET M2 | 25 | 33 | 45 | 55 | ••• |
| ⋮ | ••• | ••• | ••• | ••• | ••• |
F I G. 2
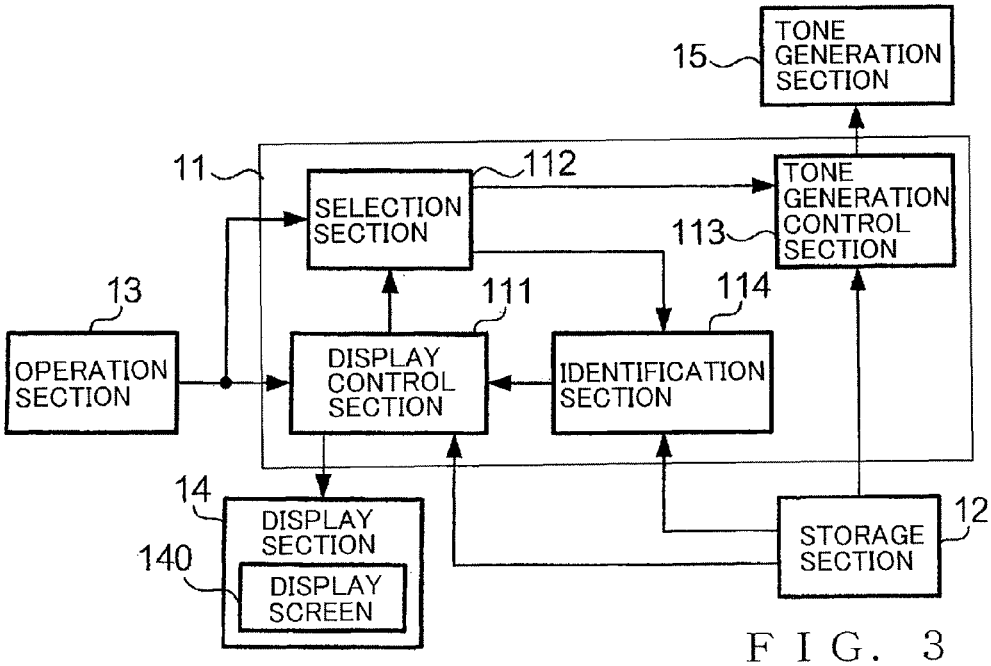
F I G. 3

TONE DATA SEARCH APPARATUS AND METHOD

BACKGROUND

The present invention relates to a technique for searching for tone data.

Electronic musical instruments and the like which generate electronic tones can generate tones of various types (i.e., various tone colors). When selecting a tone color to be used, a user searches for a desired tone color by checking how individual tone colors sound. With an electronic musical instrument capable of generating great many tone colors, the number of tone colors that are presented as selection candidates becomes enormous, making tone color selection very difficult. Thus, there has been employed a technique which allows a user to perform a search by designating search conditions, to narrow down selection candidates to some degree. One example of such a technique is disclosed in Japanese Patent Application Laid-open Publication No. 2002-7416.

Performing a search to narrow down selection candidates can facilitate selection of a tone color. If a desired tone color has not been successfully searched out, the user has to make a search all over again using different search conditions. In such a case, the user has to re-figure out appropriate search conditions such that the desired tone color can be presented. Thus, a long time would be required before the desired tone color can be reached or successfully searched out. Sometimes, appropriate search conditions cannot be decided or figure out, and the user has to compromise on, or reluctantly accept, a tone color different from the desired tone color.

SUMMARY OF THE INVENTION

In view of the foregoing, it is an object of the present invention to provide an improved technique for facilitating selection of a tone of a desired tone data set (e.g., tone color) even where there are a great number of tone data sets (e.g., tone colors) presented as selection candidates.

In order to accomplish the above-mentioned object, the present invention provides an improved tone data search apparatus, which comprises: a storage section which stores therein a plurality of tone data sets each representative of a tone waveform and stores therein a plurality of character data sets in association with the individual tone data sets, each of the character data sets representing content of the tone waveform, represented by a corresponding one of the tone data sets, in character quantities or quanta; a display control section which causes a display section to display an image presenting, as selection candidates, some of the plurality of tone data sets stored in the storage section; a selection section for a user to select at least one of the tone data sets displayed on the display section as the selection candidates; and an identification section which searches for and identifies, from said storage section, a plurality of the character data sets similar to the character data set corresponding to the at least one of the tone data sets selected by the user via the selection section. The display control section causes the display section to further display an image presenting, as selection candidates, a plurality of the tone data sets associated with the plurality of character data sets identified by the identification section, to thereby permit narrowed selection for a tone by the user via the selection section.

According to the present invention, a plurality of tone data sets, each representative of a tone waveform, are stored in the storage section, but also a plurality of character data sets are stored in the storage section in association with the individual tone data sets, each of the character data sets representing content of the tone waveform, represented by the corresponding tone data set, in character quantities or quanta. Because the present invention is arranged to search out a user-desired tone data set (e.g., tone color) by sequentially performing narrowed or refined searches with the character data sets as objects of search, it can readily search out the user-desired tone data set (e.g., tone color) even in a case where there are great many tone data sets (e.g., tone colors) presented as selection candidates.

The present invention may be constructed and implemented not only as the apparatus invention as discussed above but also as a method invention. Also, the present invention may be arranged and implemented as a software program for execution by a processor such as a computer or DSP, as well as a storage medium storing such a software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which:

FIG. 1 is a block diagram showing an example general setup of a tone generation apparatus according to an embodiment of the present invention;

FIG. 2 is a diagram showing a correspondency table employed in the embodiment;

FIG. 3 is a block diagram explanatory of structural arrangements for implementing a data search function in the embodiment;

DETAILED DESCRIPTION

Figure 4:
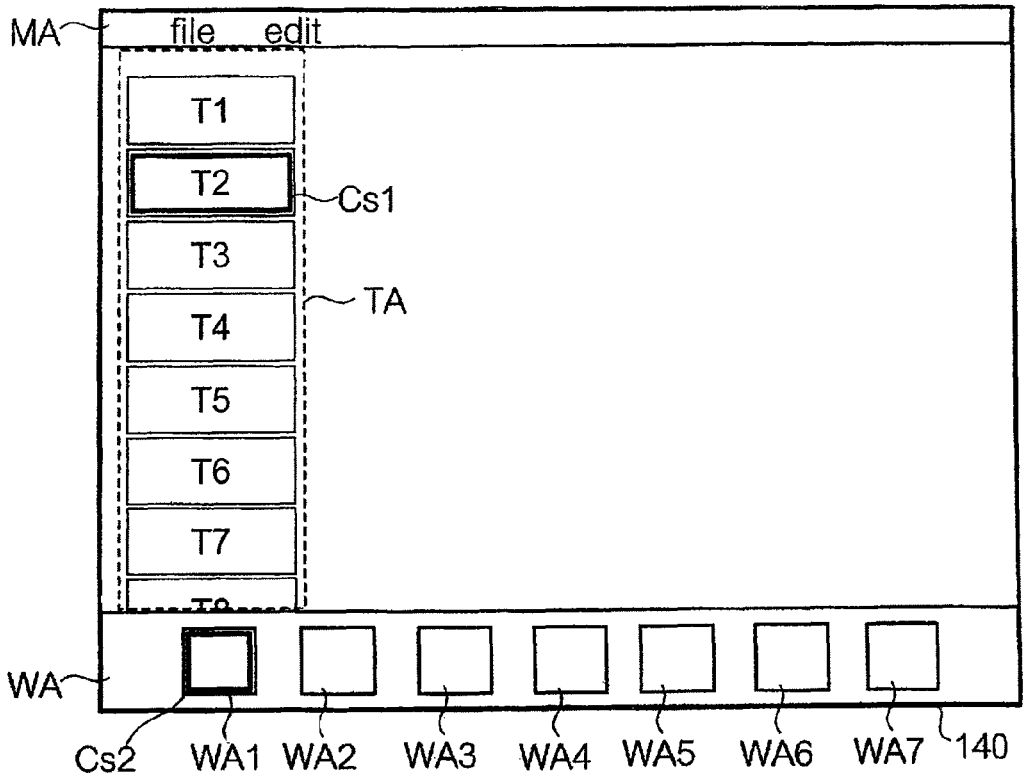
FIG. 4 is a diagram explanatory of a first example of display on a display screen during execution of the data search function in the embodiment.

FIG. 1 is a block diagram showing an example general setup of a tone generation apparatus 1 according to an embodiment of the present invention. The tone generation apparatus 1, which is suited for use, for example, in electronic musical instruments, portable telephones, PDAs (Personal Digital Assistants), has pre-installed therein a search program for performing a data search function. The data search function employed in the instant embodiment is a function for searching for a desired tone data set from among a plurality of tone data sets representative of tone waveforms corresponding to tones of various tone colors.

As shown in FIG. 1, the tone generation apparatus 1 includes a control section 11, a storage section 12, an operation section 13, a display section 14 having a display screen 140, a tone generation section and an interface 16, and these components are connected with one another via a bus. The following describe constructions of the individual components of the tone generation apparatus 1.

[Hardware Setup]

The control section 11 includes a CPU (Central Processing Unit), a ROM (Read-Only Memory), a RAM (Random Access Memory), etc. The CPU controls the individual components of the tone generation apparatus 1 via the bus to perform various functions, by loading control programs, stored in the ROM, into the RAM and executing the loaded control programs. Further, the control section 11 performs the data search function by executing the search program stored in the ROM or the like. The RAM functions also as a working area to be used by the CPU in performing processing on various data etc.

The storage section 12, which is a storage device, such as a non-volatile memory or hard disk device, which has prestored therein a plurality of tone data sets, a plurality of character data sets, a correspondency table associating the tone data sets with the character data sets, and search templates. The above-mentioned control programs may be prestored in the storage section 12 rather than in the ROM. Note that the storage section 12 may alternatively be in the form of a storage means, such as an external non-volatile memory, connected to the tone generation apparatus 1 via a connection interface. The following describe the tone data sets, character data sets, correspondency table and search templates.

Each of the tone data sets comprises data representative of a waveform signal of a tone having a predetermined time length (e.g., several hundreds of milliseconds). The tone data sets stored in the storage section 12, each representing a tone of a different tone color, are assigned tone data names (IDs), such as tone data set M1, tone data set M2, . . . .

Each of the character data sets comprises vector data representing content of a tone represented by a tone data set, in (using) a plurality of types of character quantities or quanta, such as quanta of intensity levels of individual frequency bands, pitch, disharmony degree, complexity degree, tome volume peak time point and tone volume peak value, etc. Values of the character quanta are each determined in advance to fall within a predetermined range from a predetermined lower limit value of "0" to a predetermined upper limit value of "100".

FIG. 2 is a diagram explanatory of the correspondency table which associates the tone data sets with the character data sets as noted above. Namely, each of the character data sets corresponding to any one of the tone data sets is associated with the tone data set in such a manner that the content of the tone represented by the corresponding tone data set is expressed or represented by the character quanta. P1, P2, P3, . . . shown in FIG. 2 indicate the character quanta. As shown in FIG. 2, the character data set corresponding to the tone data set M1 represents the content (tone color) of the tone as character quanta P1=10, P2=45, P3=30, P4=73, . . . . In the illustrated example, the character data include up to character quantum Pn; that is, the content of the tone is represented by an n-dimensional vector.

The search templates are each a template defining predetermined search conditions. A plurality of such search templates are prestored in the storage section 12 and define different search conditions. The search conditions are used to designate a character data set from the storage section 12; for example, they indicate ranges (upper and lower limit values), designated values, etc. of the individual character quanta. Hereinafter, the different search templates will hereinafter be referred to as "search template 1", "search template 2", "search template 3", . . . .

Referring back to FIG. 1, the operation section 13 is an operation means operable by a user, which comprises, for example, a keyboard, a mouse, a touch sensor provided on a surface portion of the display screen 140, etc., and, which, in response to operation performed thereon by the user, outputs, to the control section 11, operation data indicative of the operation by the user.

The display section 14 is a display means comprising, for example, a liquid crystal display including the display screen 140 that displays images under control of the control section 11. During execution, by the control section 11, of the search program, images like those shown in FIGS. 4 to 7 are displayed on the display section 140.

The tone generation section 15 is a tone generation means including a DSP (Digital Signal Processor) that performs tone generation under control of the control section 11, a speaker, etc. During execution, by the control section 11, of the search program, the tone generation section 15 performs generation of a tone corresponding to a tone data set stored in the storage section 12, etc.

The interface 16 comprises, for example, a wired connection terminal for connecting the embodiment of the tone generation apparatus 1 with an external apparatus in a wired manner, a wireless connection means for connecting the embodiment of the tone generation apparatus 1 with an external apparatus in a wireless manner, a communication means for connecting the embodiment of the tone generation apparatus 1 with an external apparatus via a base station or network, etc., and it communicates (transmits and receives) various data with the connected external apparatus. The foregoing have been a description about the constructions of the individual components of the tone generation apparatus 1.

[Data Search Function]

The following describe the data search function implemented by the control section 11 executing the search program, with reference to FIG. 3. Note that part or whole of structural arrangements for implementing the data search function may be implemented by hardware.

FIG. 3 is a block diagram explanatory of the structural arrangements for implementing the data search function in the instant embodiment. The control section 11 executes the search program to construct a display control section 111, selection section 112, tone generation control section 113 and identification section 114 for implementing the data search function.

The display control section 111 causes the display screen 140 to display images (e.g., tone data set names, images corresponding to content of character data sets, etc.) indicative of tone data sets designated by the identification section 114. For convenience of description, a simpler phrase "the display control section 111 displays tone data sets on the display screen 140" and the like will be used hereinbelow. Such images constitute a visual display of tone data sets presented as selection candidates as will be later described. Further, the display control section 111 displays, on the display screen 140, a cursor Cs1 (FIG. 4) for selecting any one of the tone data sets displayed as the selection candidates, and moves the cursor Cs1 in accordance with operation data given from the operation section 13.

Further, the display control section 111 causes the display screen 140 to display images, as shown in FIGS. 4 to 7, including an image indicative of search templates stored in the storage section 12. For convenience of description, a simpler phrase "the display control section 111 displays search templates" and the like will be used hereinbelow.

Furthermore, the display control section 111 outputs, to the selection section 112, information indicative of a search template and tone data set currently displayed in correspondence with a current displayed position of the cursor Cs1 (i.e., search template and tone data set currently designated by the cursor Cs1). Detailed examples of such displays will be described later.

Once it is identified, on the basis of the information output by the display control section 111, that the tone data set designated by the cursor Cs1 has been changed to another tone data set through movement of the cursor Cs1, the selection section 112 recognizes the tone data set, displayed at the position where the cursor Cs1 is currently displayed (i.e., newly designated by the cursor Cs1), as a selected tone data set and outputs, to the tone generation control section 113, information indicative of the selected tone data set.

Further, once particular operation data (in this case, operation data indicative of user's operation instructing a decision) is received from the operation section 113, the selection section 112 outputs, to the identification section 114, information indicative of a search template or tone data set currently designated by the cursor Cs1.

Once the information indicative of the tone data set is received from the selection section 112, the tone control section 113 reads out the tone data set from the storage section 12 and controls the tone generation section 15 so that a tone represented by the tone data set is audibly generated by the tone control section 15.

Once the information indicative of the currently-designated tone data set is received from the selection section 112, the identification section 114 references the storage section 112 to acquire the character data set corresponding to the tone data set. Then, the identification section 114 searches the storage section 12 to identify a plurality of character data sets similar to the acquired character data set. According to one example similarity determination criterion used in the embodiment for determining similarity between the acquired character data set and the other character data sets stored in the storage section 12, comparisons are made between the acquired character data set and the other character data sets, and each of the other character data sets which has an n-dimensional distance (e.g., Euclidean distance, Mahalanobis distance or the like) smaller than a predetermined distance value are determined to be similar to the acquired character data set. As another similarity criterion, a predetermined number of the compared character data sets closest in the n-dimensional distance to the acquired character data set may be determined to be similar to the acquired character data set. Alternatively, any of the compared other character data sets, which has similarity, calculated by a well-known method, higher than predetermined similarly may be determined to be similar to the acquired character data set. Further, whether the compared other character data sets are similar to the acquired character data set may be determined in accordance with the known scheme as disclosed in Japanese Patent Application Laid-open Publication No. 2008-129135 (corresponding to U.S. Pat. No. 7,542,444 or EP 1,923,863).

Note that the identification section 114 may be arranged to always identify a plurality of character data sets that are similar to the acquired character data set.

Further, once the information indicative of the currently-designated search template is acquired from the selection section 112, the identification section 114 searches for and identifies, from the storage section 12, character data sets satisfying search conditions defined by the acquired search template. Such character data sets satisfying the search conditions are, for example, ones included in ranges of individual character quanta predetermined as the search conditions and similar to designated values of the individual character quanta predetermined as the search conditions. Note that, when such character data sets are to be identified by acquisition of the aforementioned information indicative of the tone data set, character data sets that become objects of search may be ones searched out on the basis of the search conditions defined by the search template, or all the character data sets stored in the storage section 12.

Once the character data sets are identified, the identification section 114 references the correspondency table to identify tone data sets corresponding to the identified character data sets, and then it instructs the display control section 111 to display the identified tone data sets.

The foregoing has been a description about the individual structural arrangements for implementing the data search function in the instant embodiment. The following describe examples of content to be displayed on the display screen 140 by the display control section 111.

[Examples of Display Based on Data Search Function]

FIGS. 4, 5, 6 and 7 are diagrams of first, second, third and fourth examples of display on the display screen 140 made on the basis of the data search function performed in the instant embodiment of the present invention. Once the data search function is started, the display control section 111 displays, on the display screen 140, content shown in FIG. 4. A menu area MA is disposed in an upper end portion of the display screen 140, and a registration area WA is disposed in a lower end portion of the display screen 140. The menu area MA is an area for the user to make various instructions for activating the search program, storing data, deactivating the search program, etc. The registration area WA is an area for registering each tone data set selected as a result of the search, which includes tone registration areas WA1, WA2, . . . , WA7 for registering tone data sets. A cursor Cs2 is provided to designate which of the tone registration areas WA1, WA2, . . . , WA7 each selected tone data set is to be stored or registered into. The tone data set thus registered in the tone registration areas WA1, WA2, . . . is used in a musical instrument, sequencer, tone generator, etc. which use the tone data set to audibly generate a tone. In the case where the tone data set is used in the musical instrument, the tone data set may be used after being converted in tone pitch, or similar tone data sets differing in tone pitch may be prestored in the storage section 12. Note that an arrangement may be made to exclude tone data sets, differing only in tone pitch, from objects of search by the identification section 114.

A template area TA is an area provided for displaying the search templates. In the illustrated example, only the search templates T1, T2, . . . , T7 and part of the search template T8 are displayed in the template area TA. The template area TA is scrollable vertically or in an up-down direction, so that the search template T8 and subsequent search templates can be displayed by vertical scrolling of the template area TA. In FIG. 4, the cursor Cs1 is shown as designating the search template T2. Once the user operates the operation section 13 to instruct a "decision" in the aforementioned state, the search template T2 is selected, so that the display screen 140 shifts to the display (or image) shown in FIG. 5.

Figure 5:
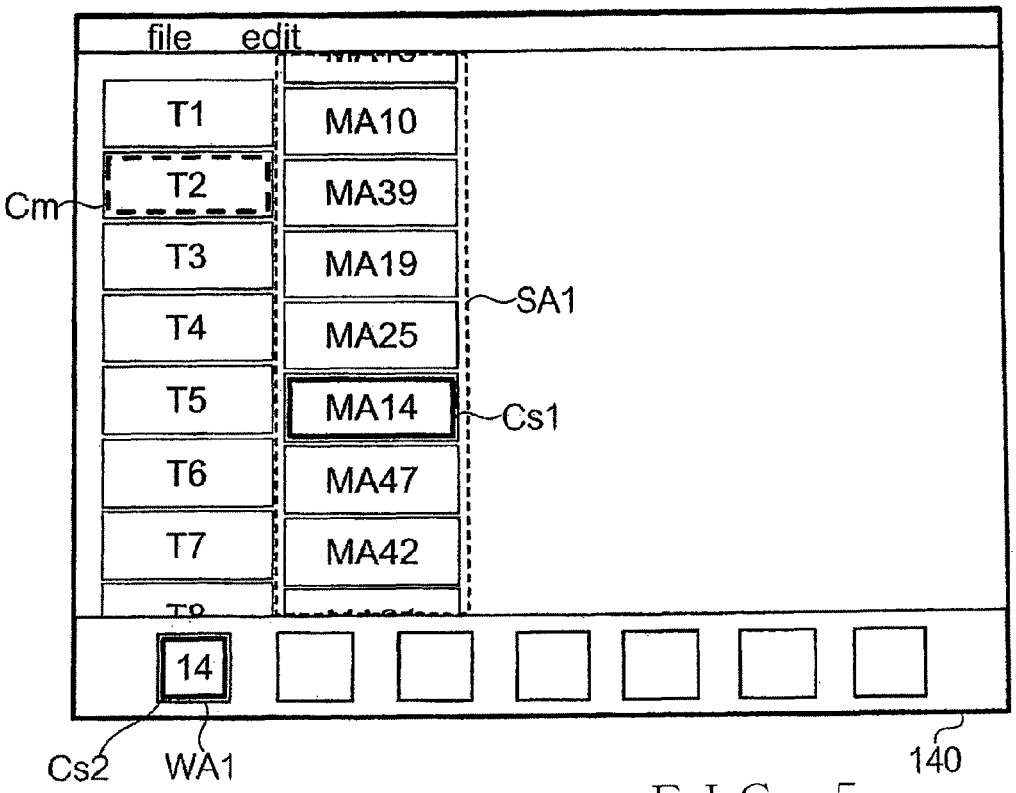
FIG. 5 is a diagram explanatory of a second example of display on the display screen during execution of the data search function in the embodiment.

A search result area SA1 shown in FIG. 5 is an area where tone data sets (MA10, MA39, . . . etc.) designated by the identification section 114 in accordance with the search template T2 are displayed as selection candidates, and this search result area SA1 is scrollable vertically similarly to the above-mentioned template area TA (other search result areas that will be later described are also scrollable vertically similarly to the template area TA). The tone color data sets displayed here correspond to the character data sets searched for and identified from the storage section 12 by the identification section 114 in accordance with the search conditions defined by the search template T2 as noted above. In the illustrated example, the tone data sets more closely matching the search conditions, i.e. more similar (smaller in distance) to the character data set defined as the search conditions, are displayed at higher positions. However, the displayed order of the tone data sets is not so limited and may be any other desired order, such as order of the tone data set numbers or random order.

Figure 6:
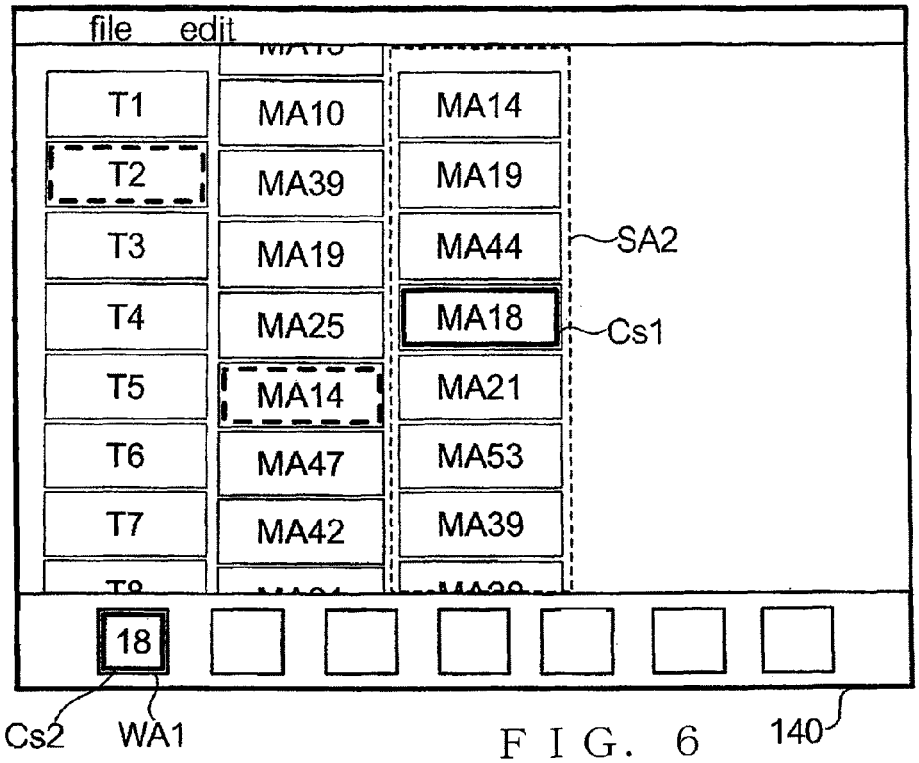
FIG. 6 is a diagram explanatory of a third example of display on the display screen during execution of the data search function in the embodiment.

A cursor Cm depicted by broken line in FIG. 5 indicates a search template that was being designated by the cursors Cs when a "decision" instruction has been made on the operation section 13, together with tone data sets (see FIG. 6).

Then, once the designation by the cursor Cs1 is changed or shifted to another tone data set in response to the user operating the operation section 13 to move the cursor Cs1 in the up-down direction, the selection section 112 recognizes the other tone data set, newly designated by the cursor Cs1, as a newly selected tone data set, so that a tone is generated by the tone generation section 15 through processing by the tone generation control section 113. For example, when the designation by the cursor Cs1 has shifted from the tone data set MA25 to the tone data set MA14, a tone represented by the tone data set MA14 is generated by the tone generation section 15. At that time, information indicative of the tone data set newly designated by the cursor Cs1 (i.e., number "14" indicative of the tone data set MA14) is displayed in the tone registration area WA1 designated by the cursor Cs2. The identification section 114 reads out, from the storage section 12, the character data set corresponding to the selected tone data and searches the storage section 12 for a plurality of character data sets similar to the read-out character data set.

Once the user instructs a decision, through designation by the cursor Cs1, on a particular tone data set (tone data set M14 in this case) close to a tone having a user-desired tone color, which he or she wants to select, by listening to tones audibly generated by the tone generation section 15 while operating the operation section 13, the display screen 140 shifts to the display (or image) shown in FIG. 6. Note that, as a modification of the user's selection, two or more tone data sets may be made selectable by the user.

A search result area SA2 shown in FIG. 6 is an area for a narrowed (or refined) search where tone data sets (MA14, MA19, etc.) designated by the identification section 114 in accordance with the character data set corresponding to the tone data set M14 are displayed or presented as selection candidates. The tone data sets displayed in the search result area SA2 correspond to character data sets having been searched out and identified from the storage section 12, by the identification section 114, as being similar to the character data set corresponding to the tone date set M14. In the search result area SA2 of FIG. 6, the tone data sets more closely matching the search conditions, i.e. more similar (smaller in distance) to the character data set defined as the search conditions, are displayed at higher positions, as in the search result area SA1. Note that the displayed order of the tone data sets is not limited to the one shown in FIG. 6 and may be any desired order, such as order of the numbers of the tone data sets or random order.

Namely, because tone data sets representative of tones similar to the tone represented by the tone date set M14 selected in the search result area SA1 are displayed in the search result area SA2, tone data sets closer to a tone of a desired tone color, which the user wants to select, are presented to the user as selection candidates in the search result area SA2. Thus, the user is allowed to readily make narrowed selection for a tone of a desired tone color from the tone data sets presented in the search result area SA2.

Then, once the user operates the operation section 13 to move the cursor Cs1 in the up-down direction in the example of FIG. 6, a tone represented by the tone data set newly designated by the cursor Cs1 is audibly generated by the tone generation section 15 through processing of the tone generation control section 113, similarly to the aforementioned. Also, information indicative of the tone data set newly designated by the cursor Cs1 (i.e., number "18" indicative of the tone data set MA18) is displayed in the tone registration area WA1 designated by the cursor Cs2. Then, once a decision of the designated tone data set MA18 is instructed by user's operation on the operation section 13, the designated tone data set MA18 is selected, so that the display screen 14 shifts to the display or image shown in FIG. 7.

Figure 7:
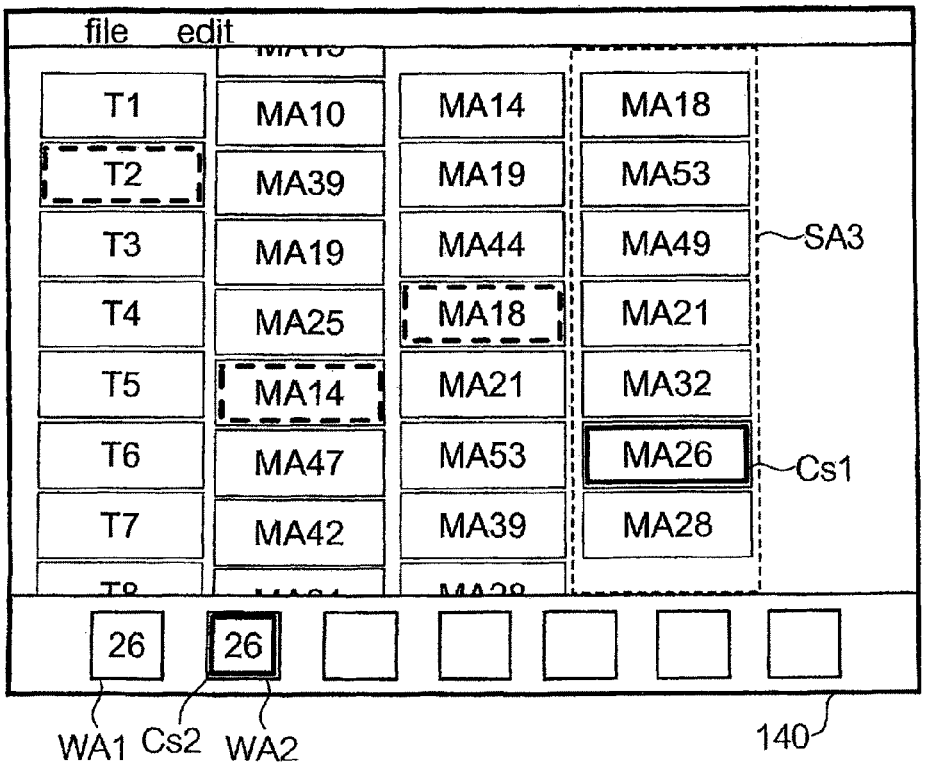
FIG. 7 is a diagram explanatory of a fourth example of display on the display screen during execution of the data search function in the embodiment.

A search result area SA3 shown in FIG. 7 is an area for a further narrowed (or refined) search where tone data sets (MA18, MA53, etc.) designated by the identification section 114 in accordance with the character data set corresponding to the tone data set MA18 are displayed or presented as selection candidates. The tone data sets displayed here in the search result area SA3 correspond to the character data sets having been searched out and identified from the storage section, by the identification section 114, as being similar to the character data set corresponding to the tone date set M18. In the search result area SA3, the tone data sets more similar to (i.e., closer in distance to) the character data set are displayed at higher positions, as in the search result area SA1. Note that the displayed order of the tone data sets is not limited to the one shown in FIG. 7 and may be any desired order, such as order of the numbers of the tone data sets or random order.

Namely, because tone data sets representative of tones similar to the tone represented by the tone date set M18 selected in the search result area SA2 are displayed in the search result area SA3, tone data sets even closer to a tone of a desired tone color, which the user wants to select, are presented to the user as selection candidates. Thus, it becomes easier for the user to make further narrowed selection for a tone of a desired tone color.

After that, the aforementioned operations (narrowed search operations) are repeated an appropriate number of times, so that the selection candidates are gradually narrowed down to tone data sets closer to a tone of a user-desired tone color. Note that the cursor Cs1 is moved back to the previously displayed selection areas, i.e. in this case, back to the template area TA, search result area SA1 and search result area SA2. For example, once the user performs operation for instructing a decision of a particular tone data set after moving the cursor Cs1 back to the search result area SA1 to designate the particular tone data set, the search result area SA3 is deleted or erased, and the search result area SA2 is updated to new content.

In the display of FIG. 7, the cursor Cs2 is shown as having been moved to the tone registration area WA2 with the cursor Cs1 designating the tone data set MA26, and thus, the tone data set MA26 has been registered in the tone registration area WA1. When a particular tone data set has been registered in the tone registration area WA1 like this, it is regarded that the narrowed search has been completed, and the original display shown in FIG. 4 may be restored where only the template area TA is displayed with the display of the search result area deleted.

The foregoing has been a description about example content displayed on the display screen 140 by the display control section 111.

As described above, the instant embodiment of the tone generation apparatus 1 presents, through the data search function, some of the tone data sets, stored in the storage section 12, as selection candidates. Then, a tone of one tone data set designated by the user from among the presented tone data sets is audibly generated, and tone data sets representative of tones similar to the audibly generated tone are presented as next selection candidates.

Thus, if the tone audibly generated and listened to by the user is close to a tone having a user-desired tone color, the tone data sets presented as the next selection candidates will represent tones similar to the tone listened to by the user. In this way, the user can select a tone data set closer to the tone having the user-desired tone color. Then, through repetition of the aforementioned operations, tone data sets presented as selection candidates can become even closer to the tone having the user-desired tone color, so that the user is allowed to readily make selection for the tone having the user-desired tone color.

Further, in the instant embodiment, where various tone data sets are presented as selection candidates, tone data sets different from what the user has so far considered as a tone having a user-desired tone color can be presented, and thus, a tone data set representative of a tone having a tone color more suited to the user can sometimes be presented to the user.

[Modification]

Whereas the foregoing have described the preferred embodiment of the present invention, the present invention may be practiced in various other manners than the preferred embodiment, as exemplified below.

Modification 1:

According to the above-described embodiment, once one of the search templates is selected by the user, the storage section 12 is searched, in accordance with search conditions corresponding to the selected search template, to identify character data sets. As a modification of the above-described embodiment, searches may be performed in advance on the basis of the search templates, and results of the searches may be prestored into a correspondency table such that tone data sets and the search templates are associated with each other in advance. Such a modification can reduce the time required for the search operations and thereby significantly increase the processing speed.

Modification 2:

As another modification of the above-described embodiment, the identification by the identification section 114 may be limited in such a manner that the number (N) of tone data sets displayed in the search result area SA2 becomes smaller than the number of tone data sets that were presented as selection candidates prior to identification of character data sets corresponding to the tone data sets, i.e. the number (M) of tone data sets displayed in the search result area SA1. Gradually reducing the number of tone data sets presented as selection candidates (i.e., N<M) like this can even further facilitate narrowed selection for a tone having a desired tone color.

In the case where the number of tone data sets presented as selection candidates is gradually reduced as noted above, a separately-generated tone data set may be included in the selection candidates. In this case, the data search function may be implemented by randomly generating character data similar to the character data corresponding to the selected tone data set and providing a generation section that generates tone data sets of tones having character quanta of the generated character data. In this case, the identification section 114 may also make character data, generated by the generation section as above, objects of search.

Modification 3:

As still another modification of the above-described embodiment, the identification by the identification section 114 may be limited in such a manner that a tone data set representative of a tone having already been audibly generated by the tone generation section 15 is excluded from tone data sets presented as selection candidates. If the user has not selected a tone once listened to by the user, it means that that tone is not of a user-desired tone color. Thus, limiting the identification by the identification section 114 as above can even further facilitate selection for a tone having a desired tone color. Note that all tone data sets that have once been presented as selection candidates, rather than just a tone data set representative of a tone having already been audibly generated by the tone generation section 15, may be excluded from the selection candidates.

Modification 4:

The above-described embodiment is constructed in such a manner that the display control section 111 displays search templates upon start of the data search function. As a modification of the above-described embodiment, the display control section 111 may display predetermined tone data sets without using search templates. The predetermined tone data sets may, for example, be randomly designated or identified by the identification section 114 from among the tone data sets stored in the storage section 12. Alternatively, the predetermined tone data sets may be tone data sets designated or identified by the identification section 114 in accordance with search conditions entered by the user via the operation section 13.

Modification 5:

Further, the above-described embodiment is constructed in such a manner that, in response to the user performing operation for instructing a decision of a particular tone data set while the cursor Cs1 is designating the particular tone data set, the tone data set is displayed in the next search area. As a modification of the above-described embodiment, the particular tone data set may be displayed in the next search area in response to the cursor Cs1 designating the particular tone data set, even when the user does not perform operation for instructing a decision of the particular tone data set.

Modification 6:

Whereas an object to be selected by the user in the above-described embodiment is a tone data set representative of, for example, a tone of a relatively short time length, the object to be selected may be a tone data set representative of an entire phrase or music piece. In such a case, the corresponding character data set may represent the content of the entire phrase or music piece in character quantities or quanta. The character quanta may be different from those employed in the above-described embodiment. Note that phrases or music pieces represented by individual tone data sets may differ in length from one another.

Further, in the above-described embodiment, the format of the tone data sets each representative of a tone waveform is not limited to the PCM data format and may be any desired one of desired coded formats, such as the DPCM and ADPCM formats. Alternatively, the format of the tone data sets may be any desired one of the compressed data formats, such as the MP and MDCT formats. As another alternative, the tone data sets need not necessarily be tone waveform data sets themselves and may be vector data sets, such as Fourier component coefficient sets.

Modification 7:

The above-described embodiment is constructed in such a manner that, each time a tone data set is selected by the user, a search result area is newly generated and displayed in a hierarchical fashion. However, the thus-generated search result area need not necessarily be displayed in a hierarchical fashion. For example, in response to selection of a tone data set in the search result area SA1, the content of the search result area SA1 may be updated to tone data sets identified by the identification section 114.

Modification 8:

The search program employed in the above-described embodiment may be provided stored in a computer-readable storage or recording medium, such as a magnetic recording medium (e.g., magnetic tape or magnetic disk), optical recording medium (e.g., optical disk), opto-magnetic recording medium or semiconductor memory. In this case, a function for reading the recording medium may be provided in the interface 16, or a device for reading the recording medium may be connected to the interface 16. Alternatively, the search program may be downloaded via a network.

The present application is based on, and claims priority to, Japanese Patent Application No. 2010-023907 filed on Feb. 5, 2010. The disclosure of the priority application, in its entirety, including the drawings, claims, and the specification thereof, is incorporated herein by reference.

What is claimed is:

1. A tone data search apparatus comprising:

a storage section which stores therein a plurality of tone data sets each representative of a tone waveform and stores therein a plurality of character data sets in association with individual ones of the tone data sets, each of the character data sets representing content of the tone waveform, represented by a corresponding one of the tone data sets, in character quanta;

a display control section which causes a display section to display an image presenting, as selection candidates, some of the plurality of tone data sets stored in said storage section;

a selection section for a user to select at least one of the tone data sets displayed on the display section as the selection candidates; and an identification section which searches for and identifies, from said storage section, a plurality of the character data sets similar to the character data set corresponding to the at least one of the tone data sets selected by the user via said selection section, wherein said display control section causes the display section to further display an image presenting, as selection candidates, a plurality of the tone data sets associated with the plurality of character data sets identified by said identification section.

2. The tone data search apparatus according to claim 1, which further comprises a tone generation control section which causes audible generation of a tone represented by the tone data set selected by said selection section.

3. The tone data search apparatus according to claim 2, wherein, when identifying the plurality of character data sets, said identification section excludes the character data set corresponding to a tone data set for which a tone has already been audibly generated via said tone generation control section.

4. The tone data search apparatus according to claim 1, wherein said identification section searches for and identifies, from said storage section, character data sets as the similar character data sets that are smaller in number than the tone data sets that were presented as the selection candidates.

5. The tone data search apparatus according to claim 1, which further comprises a template selection section for the user to select one of a plurality of search templates, and wherein, in correspondence with the one search template selected by said template selection section, said display control section causes the display section to display an image presenting, as selection candidates, a plurality of the tone data sets associated with a plurality of the character data sets.

6. A computer-implemented method for searching for a tone data set, comprising:

a display control step of causing a display section to display an image presenting, as selection candidates, some of a plurality of tone data sets stored in a storage section, the storage section not only storing therein the plurality of tone data sets each representative of a tone waveform but also storing therein a plurality of character data sets in association with individual ones of the tone data sets, each of the character data sets representing content of the tone waveform, represented by a corresponding one of the tone data sets, in character quanta;

a selection step of prompting a user to select at least one of the tone data sets displayed on the display section as the selection candidates; and an identification step of searching for and identifying, from said storage section, a plurality of character data sets similar to the character data set corresponding to the at least one of the tone data sets selected by the user, wherein said display control step causes the display section to further display an image presenting, as selection candidates, a plurality of the tone data sets associated with the plurality of character data sets identified by said identification step.

7. A computer-readable storage medium containing a program for causing a computer to perform a method for searching for a tone data set, said method comprising:

a display control step of causing a display section to display an image presenting, as selection candidates, some of a plurality of tone data sets stored in a storage section, the storage section not only storing therein the plurality of tone data sets each representative of a tone waveform but also storing therein a plurality of character data sets in association with individual ones of the tone data sets, each of the character data sets representing content of the tone waveform, represented by a corresponding one of the tone data sets, in character quanta;

a selection step of prompting a user to select at least one of the tone data sets displayed on the display section as the selection candidates; and an identification step of searching for and identifying, from said storage section, a plurality of character data sets similar to the character data set corresponding to the at least one of the tone data sets selected by the user, wherein said display control step causes the display section to further display an image presenting, as selection candidates, a plurality of the tone data sets associated with the plurality of character data sets identified by said identification step.

8. The computer-implemented method according to claim 6, which further comprises a tone generation control step which causes audible generation of a tone represented by the tone data set selected by said selection step.

9. The computer-implemented method according to claim 8, wherein, when identifying the plurality of character data sets, said identification step excludes the character data set corresponding to a tone data set for which a tone has already been audibly generated via said tone generation control step.

10. The computer-implemented method according to claim 6, wherein said identification step searches for and identifies, from said storage section, character data sets as the similar character data sets that are smaller in number than the tone data sets that were presented as the selection candidates.

11. The computer-implemented method according to claim 6, which further comprises a template selection step for the user to select one of a plurality of search templates, and wherein, in correspondence with the one search template selected by said template selection step, said display control step causes the display section to display an image presenting, as selection candidates, a plurality of the tone data sets associated with a plurality of the character data sets.

12. The computer-readable storage medium according to claim 7, which further comprises a tone generation control step which causes audible generation of a tone represented by the tone data set selected by said selection step.

13. The computer-readable storage medium according to claim 12, wherein, when identifying the plurality of character data sets, said identification step excludes the character data set corresponding to a tone data set for which a tone has already been audibly generated via said tone generation control step.

14. The computer-readable storage medium according to claim 7, wherein said identification step searches for and identifies, from said storage section, character data sets as the similar character data sets that are smaller in number than the tone data sets that were presented as the selection candidates.

15. The computer-readable storage medium according to claim 7, which further comprises a template selection step for the user to select one of a plurality of search templates, and wherein, in correspondence with the one search template selected by said template selection step, said display control step causes the display section to display an image presenting, as selection candidates, a plurality of the tone data sets associated with a plurality of the character data sets.

* * * * *